US006331128B1

(12) United States Patent
Schmick

(10) Patent No.: US 6,331,128 B1
(45) Date of Patent: Dec. 18, 2001

(54) FLEXIBLE CORE RECREATIONAL DEVICE

(76) Inventor: Christie Liscomb Schmick, 10082 Hatton Ferry Rd., Scottsville, VA (US) 24590

( * ) Notice: Subject to any disclaimer, the term of this patent is extended or adjusted under 35 U.S.C. 154(b) by 0 days.

(21) Appl. No.: 09/427,422

(22) Filed: Oct. 26, 1999

(51) Int. Cl.[7] ..... B63B 35/73

(52) U.S. Cl. ..... 441/129; 441/65; 441/67; 441/131

(58) Field of Search ..... 441/67, 81, 129, 441/130, 131, 132, 65, 74

(56) References Cited

U.S. PATENT DOCUMENTS

| | | | | |
|---|---|---|---|---|
| 3,095,586 | * | 7/1963 | Baier | 441/81 |
| 3,111,696 | * | 11/1963 | Lo | 441/81 |
| 3,372,412 | * | 3/1968 | Robertson | 441/81 |
| 3,579,683 | * | 5/1971 | Robertson | 441/81 |
| 3,782,458 | * | 1/1974 | Slack | 441/5 |
| 3,869,744 | * | 3/1975 | MacMillan et al. | 441/81 |
| 4,017,927 | * | 4/1977 | Massey | 441/81 |
| 4,059,859 | * | 11/1977 | Hull | 441/81 |
| 4,276,670 | * | 7/1981 | Marchello et al. | 441/115 |
| 4,424,043 | * | 1/1984 | Behl | 441/81 |
| 4,742,095 | * | 5/1988 | Markusch et al. | 523/322 |
| 4,936,804 | | 6/1990 | Dowdeswell | 441/6 |
| 5,295,884 | | 3/1994 | Whiteley | 441/122 |
| 5,476,404 | * | 12/1995 | Price | 441/131 |
| 5,571,036 | | 11/1996 | Hannigan | 441/129 |
| 5,628,658 | | 5/1997 | Clifford | 441/130 |
| 5,900,441 | | 5/1999 | De Witte et al. | 521/159 |
| 5,900,442 | | 5/1999 | Leenslag et al. | 521/174 |
| 5,922,348 | | 7/1999 | Wegner | 424/443 |
| 5,938,993 | | 8/1999 | Greene | 264/46.4 |
| 5,944,389 | | 8/1999 | Zenba et al. | 297/452.48 |
| 5,950,875 | | 9/1999 | Lee | 222/145.5 |
| 5,952,053 | | 9/1999 | Colby | 427/393 |
| 5,952,065 | | 9/1999 | Mitchell et al. | 428/35.4 |
| 5,953,778 | | 9/1999 | Hiatt | 5/716 |
| 5,961,019 | | 10/1999 | Gleason et al. | 234/643 |
| 5,962,147 | | 10/1999 | Shalub et al. | 428/492 |
| 6,032,606 | * | 3/2000 | Fulks | 114/357 |

* cited by examiner

*Primary Examiner*—Sherman Basinger
(74) *Attorney, Agent, or Firm*—Sheldon H. Parker

(57) ABSTRACT

A recreational device having a moisture and tear and UV resistant outer surface is disclosed. The core is manufactured from a flexible, lightweight material having a weight of about 2.0–2.5 pounds per cubic foot, such as two-part polyurethane or closed cell foam through injection or open molding. An inner core can be placed concentrically within the outer core, with the inner core having a second density. The flexible outer surface can be integral to the core or applied subsequent to manufacturing and can be materials such as a latex or neoprene. Preferably at least one indentation is molded into the core to receive a container. At least one connector receiving area, such as a directly inserted clip, ring or other fastener, can be embedded into the core to receive an attachment strap to attach multiple devices together. The ends of the attachment straps are designed to interact with the connector receiving areas of the tube, thereby enabling an attachment strap to span the diameter of the device, being affixed to opposing connectors.

20 Claims, 4 Drawing Sheets

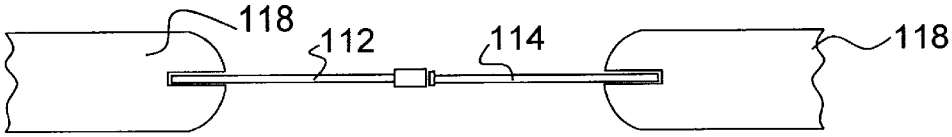
Figure 5
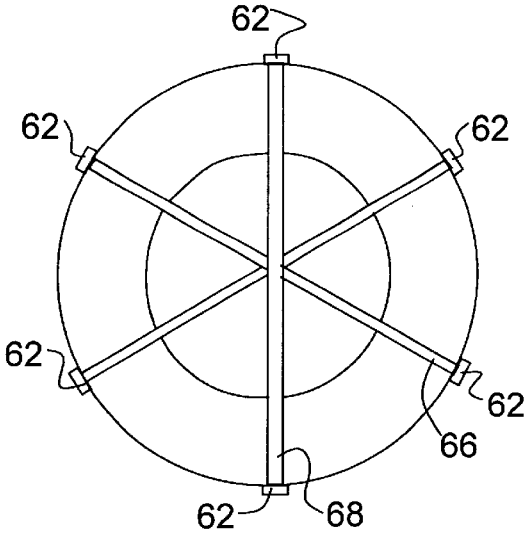
Figure 6
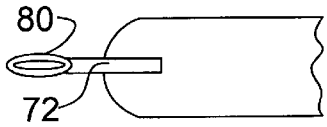
Figure 7
Figure 8
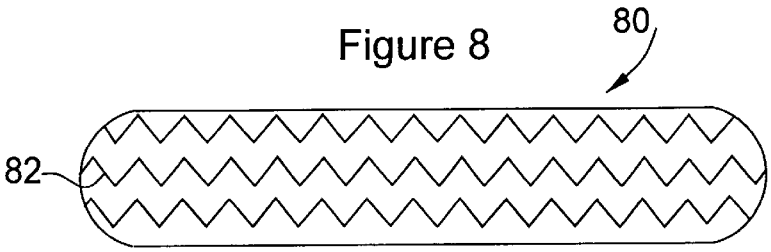

FLEXIBLE CORE RECREATIONAL DEVICE

BACKGROUND OF THE INVENTION

1. Field of the Invention

The invention relates to a solid, non-inflatable recreational device, such as an inner tube, that provides the benefits of the prior art inflated devices without the maintenance.

2. Brief Description of the Prior Art

Inner tubes and other air filled devices have been used for recreational purposes for decades. One of the inherent problems associated with the standard inner tubes is the ease in which they puncture and tear. U.S. Pat. No. 4,936,804 recognizes the added durability of the closed cell foam, teaching the use of the material to make buoyancy aids. The buoyancy aids are small circular devices placed around the person's arms and legs to assist in maintaining the body afloat. Due to the size and limited buoyancy, the aids of the '804 patent are not difficult to construct, nor is weight an issue. As stated in the '804 patent, the aids "can be molded as an annular structure or formed from sheets of closed cell plastic foam cut into strips." While this manufacturing method is appropriate for the devices of the '804 patent, it is not applicable to actual flotation devices, such as inner tubes. Further, the small size of the '804 devices reduces the concern for overall weight of the devices, with other criteria, such as flexibility and floatability being the primary concern.

In U.S. Pat. No. 5,571,036 a linear tube of extruded foam is used as the buoyancy portion of floatation device. The '036 linear tube is designed to only support a user's head above water, as long as the user's head is placed within the "U" bend of the tube. In the '036 device, the doubled portion of the "U" bend is the only place along the length of the tube that has sufficient buoyancy.

The flotation device of the U.S. Pat. No. 5,628,658 also presents the problem of insufficient buoyant material to maintain a user's weight above water. The '658 is not, however, intended to maintain the user's body above water but rather assist in maintaining the user's head above water.

The linear tube of the '036 and '658 devices cannot merely be thickened and the ends secured to form a circular tube that has sufficient buoyancy to support a person. By the time there is sufficient material to support the weight of a person, the flexibility is minimized and the tube cannot be placed into a circular configuration. Further, since the overall amount of material used to manufacture the linear tubes is small enough, the overall weight is not of consequence. However, once sufficient material is used to form a circular tube able to support an average adult, the weight of the material of manufacture becomes a concern.

U.S. Pat. No. 5,295,884 recognizes the value in using plastics foam, however the design of the '884 devices does not address the construction problems encountered in manufacturing a circular tube of the configuration disclosed herein. The '884 device uses smaller rings placed around, and normal to, a larger ring. As noted in the '884 patent the rings abut together at the inner part of the annulus, while being separated at the outer periphery. This design avoids the problems associated with manufacturing circular tubes as well as eliminating the weight issues associated with solid objects having the mass required to support an average adult's body.

The disclosed device overcomes the weight and configuration problems associated with the prior art to produce a durable, lightweight device suitable for recreational use.

SUMMARY OF THE INVENTION

A recreational device having a moisture and tear and UV resistant outer surface is disclosed. The device has at least one core manufactured from a flexible, lightweight, solid material having a weight of about 2.0–2.5 pounds per cubic foot, such as two-part polyurethane or closed cell foam, through injection or open molding. An inner core can be placed concentrically within the outer core, with the inner core having a second density. To maintain the lightweight, the inner core can be air filled or lighter weight foam. The flexible outer surface can be integral to the core or applied subsequent to manufacturing by spraying or dipping. The flexible outer surface is a material such as a latex or neoprene.

The device can be molded with at least one indentation dimensioned to receive a container, such as a soda or juice can. At least one connector receiving area, such as a directly inserted clip, ring or other fastener, can be embedded into the core to receive an attachment strap to attach multiple devices together. The ends of the attachment straps are designed to interact with the connector receiving areas of the tube, thereby enabling an attachment strap to span the diameter of the device, being affixed to opposing connectors. The core can be molded in a pattern or design.

BRIEF DESCRIPTION OF THE DRAWINGS

The advantages of the instant disclosure will become more apparent when read with the specification and the drawings, wherein:

FIG. 5 is a cut away side view of connection members for use with the tube of FIG. 1;

FIG. 6 is a top view of the disclosed tube modified for use with a cooler;

FIG. 7 is a cutaway side view of a flange and loop connector for use with the disclosed tube;

FIG. 8 is a side view of the disclosed tube with a "tire tread" pattern molded into the outer surface;

DETAILED DESCRIPTION OF THE INVENTION

Figure 1:
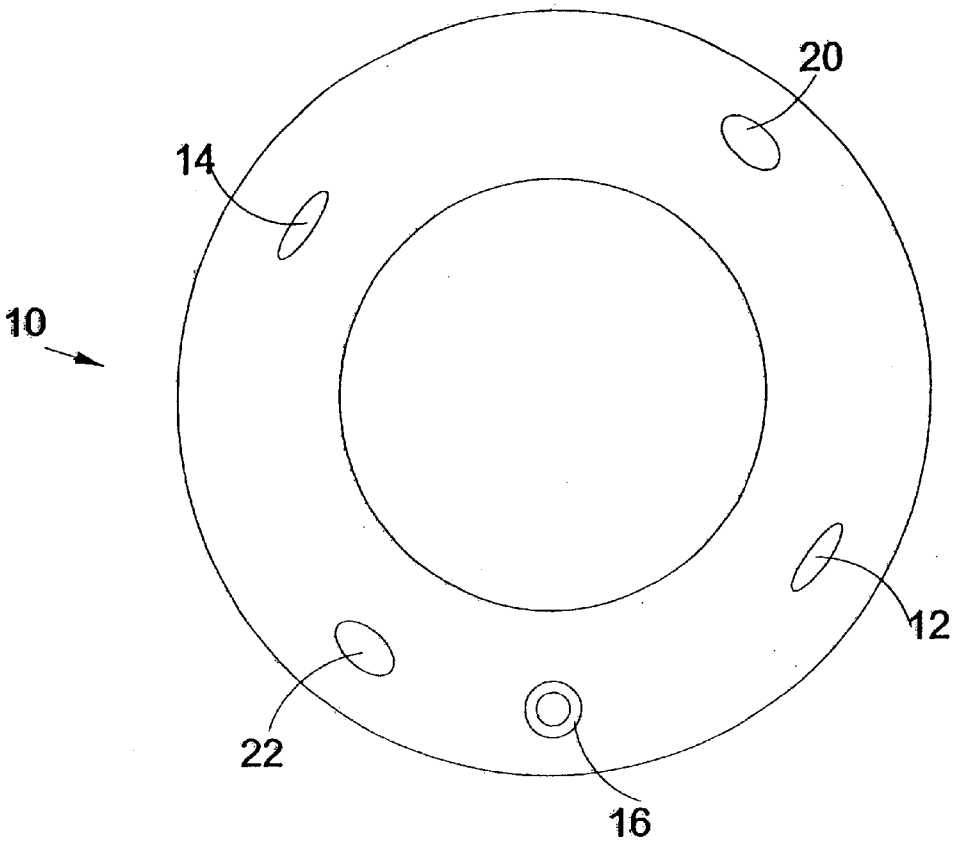
FIG. 1 is a top view of a tube in accordance with the disclosure.

Inflated tire tubes have been used for years for water and snow sports due to their low cost. Maintenance however has been a problem as the inflated tubes are prone to punctures and tears as well as UV deterioration. The typical rubber inner tube used for river tubing, has a life expectancy of about six (6) months, providing it is not punctured or torn beyond patching. This is primarily due to UV deterioration of the rubber and partially due to the thinning of the rubber caused by general use. This problem is not reserved for inner tubes but affects any type of inflated device, especially those used in ocean and other aquatic sports, such as rafts, canoes, kayaks, pool toys, as well as snow sleds, etc.

The disclosed device eliminates the maintenance difficulties associated with prior art devices by providing a solid, yet buoyant, device for use in water, snow, ice, or other "slidable" or "floatable" surfaces. For simplicity in referring to the disclosed device, references will be made to a tube, however, it should be noted that this in no way limits the scope of the invention. Additionally, the "add-ons", such as the cup holder and tethering attachments, can be used on any configuration.

The advantages to the disclosed tube go beyond the ease of maintenance. As the tube does not rely on air for its buoyancy, a surface puncture will not deflate the tube, thereby increasing the safety of the tube. Nor can the tubes be over or under-inflated and the absence of valves enhances the comfort for the user. Further the life span of the tube is increased from less than six (6) months to a life span predominately reliant upon the UV durability of the chosen material. As the appropriate materials improve in UV resistance and durability, the life span of the tube will increase since the design of the disclosed tube makes it impervious to all but intentional cutting into pieces. The material of manufacture must be lightweight with the ability to float, even if cut in half. The non-porous, non-chafing outer surface must be easy to keep clean, further making the tube hygienic.

One of the greatest obstacles to overcome is the weight of the tube since the recreational use of the tube requires that it be lightweight and easy to carry. Currently several sizes of tubes are generally available for use, ranging in circumference from about 120 inches to about 77 inches, with an ideal weight of about six (6) pounds to ten (10). The use of prior art methods of manufacture and materials to produce a solid tube result in a tube having a weight far greater than the optimum weight of less than ten (10) pounds for the 120 inch tube. In order to reduce the weight, a lightweight material such as closed cell foam, or the equivalent thereto, is used to form the tube. An example of a material that is flexible, lightweight and resilient is a two-part urethane, such as Vult-A-Foam™. To maintain structural integrity while maintaining flexibility the ratio of the two parts is preferably about 50/50, although in some instances the ratio can be as high as about 70/30. The molded urethane is dipped in a neoprene or latex to seal and protect the urethane from the elements and normal use. In order to maintain the preferred weight of six (6) to twelve (12) pounds, and preferably less, the material should have a weight of about 2.0–2.5 lbs. per cubic foot. Ideally, a 20 inch tube containing about 3.02 cubic ft. tube and constructed from material weighing 2 lbs. per cubic foot will weight about 6.04 pounds. The ideal weight must also take into consideration the final use. Tubes used to float down a river will be taking less abuse, and therefore require less durability, which generally translates to less weight, than a kayak. The applicable materials for use with the disclosed devices increase in durability while decreasing in weight as new materials are developed. The materials for use with the disclosed devices should meet the specified criteria as set forth herein and the suggested materials are for example only. Although some materials have a self-skin, few materials will have an outer self-skin of sufficient durability to withstand the intended use. When determining the weight of material being used, the additional weight presented by a durable skin must be accounted for in determining the foam weight. The skin can be vinyl paint or a vinyl material extruded around, or affixed to by dipping or other means, the core material. The type of outer skin will be dependent upon the core material used and will be evident to those skilled in the art.

Detailed description of two part polyurethanes, closed cell foams and foaming methods are disclosed in the following patents, which are incorporated herein by reference as through recited in full. U.S. Pat. No. 5,962,147, 5,961,019, 5,953,778, 5,952,065, 5,952,053, 5,950,875, 5,944,389, 5,938,993, 5,922,348, 5,900,442, and 5,900,441. These patents disclose such information as material compositions, mixing and molding processes. However, they do not disclose any of the criteria disclosed herein for recreational devices, nor do they address the problems associated with the disclosed invention.

As known in the art, the weight of a closed cell foam is determined by the size of the cells, the larger the cell the lighter the material. However, as the cell size increases, the integrity of the foam is reduced. In order to reduce the weight of the tube and maintain strength, dual chambers can be used. The more durable, small cell foam is used to form the outer chamber of the tube, while the inner chamber contains either a lighter weight material or injected or trapped air.

Figure 2:
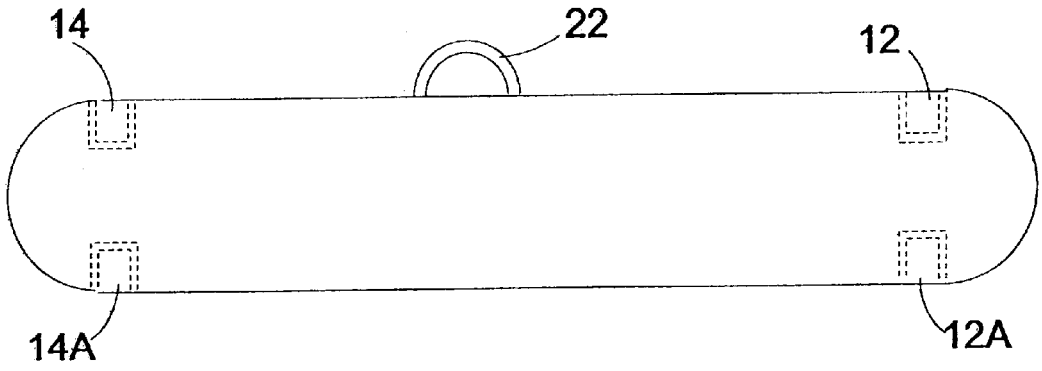
FIG. 2 is a side view of the tube of FIG. 1.

The tubes can be manufactured through extrusion or injection molding, depending upon the specific material used. In the event the device is not molded as a one-piece unit, i.e. top and bottom halves, the adhesive used to affix the pieces must be of the type to withstand the flexing of the tube, as well as hostile elements. FIGS. 1 and 2 illustrate one embodiment of a tube 10 in accordance with the instant disclosure. The body 18 of the tube 10 is provided with a can holder 16 that is either molded into the body 18 at time of manufacture or cut into the tube after production. Although a "stepped" circular can holder 16 is illustrated, any configuration or size can be substituted or added. The stepped holder is preferred to increase versatility, however this will be based on end use and will be obvious to those skilled in the art. Tubes that are designated "cooler tubes" may contain several can holders or, alternatively, be molded to form a cooler/tube integral unit. The tube 10 further includes connection ports 12 and 14 that are used to attach the tubes together. The connection ports 12 and 14 can be deep indentations molded into the body 18 with a counter part 12A and 14A on the reverse side of the body 18. Spring clamps can be used to secure the tubes to one another. Other types and designs of clamps, D-rings or fasteners, can also be used and will be obvious to those skilled in the art. Alternatively, the connection ports can extend through the tube to enable a rope or other strap to pass through the ports.

Figure 3:
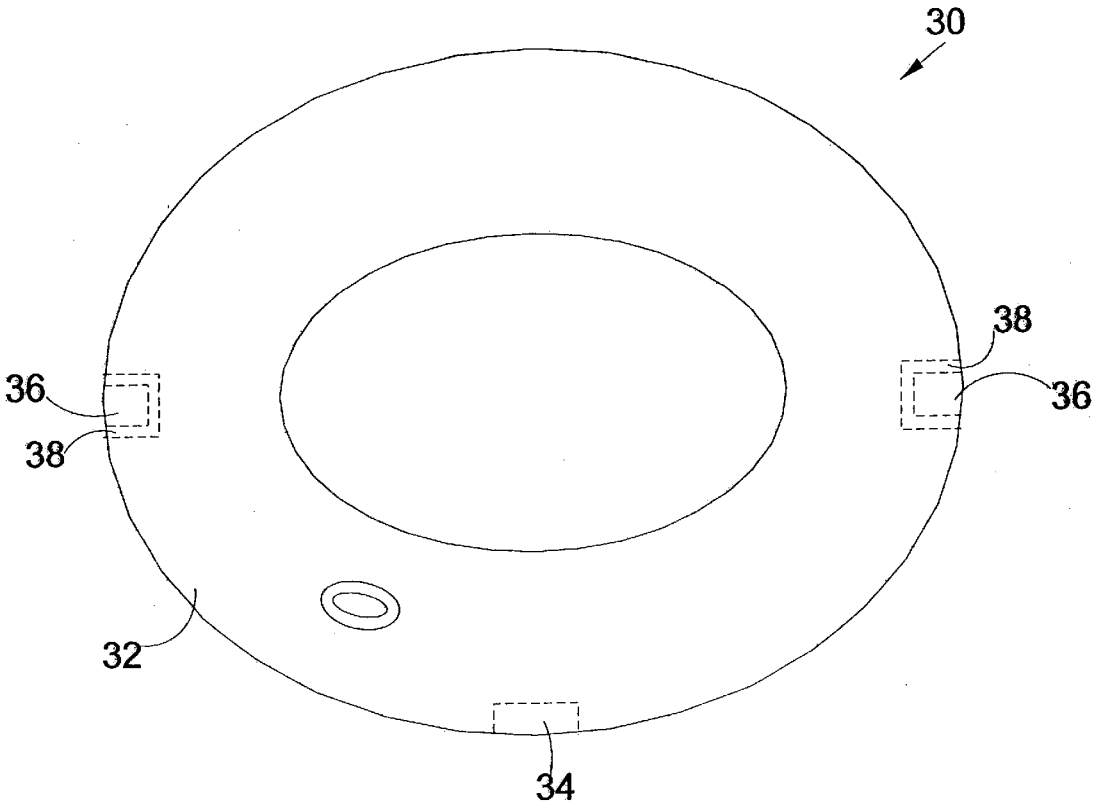
FIG. 3 is a perspective view of an alternate tube embodiment.
Figure 4:
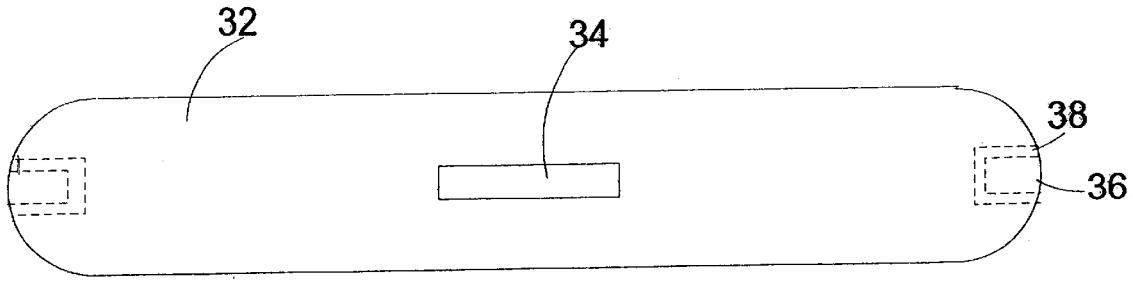
FIG. 4 is a side view of the tube of FIG. 3.

An alternate tube design is illustrates in FIGS. 3 and 4 wherein the tube 30 is provided with recessed connections 36 and a carrying handle 34 placed on the side of the tube body 32. The carrying handle 34 illustrated is recessed into the body 32, however a handle extending from the plane of the tube can also be used. This is based on manufacturing preferences and end use and will be obvious to those skilled in the art. The recessed connections 36 can contain a female clip, such as, such as a plastic snap 38, embedded directly into the tube body 32. Preferably, the snap connector 38 is removable from the body 32 to permit replacement in the event the connector 38 is broken. The recessed connections 36 can be molded directly into the sides of the tube or added after manufacture. The method of attachment of the female clips will be depended upon the material of manufacture, style of the clip, etc. and will be evident to those skilled in the art.

In the embodiment illustrated in FIG. 5, the tubes 118 are connected through use of a strap/male connector combination 112 and strap/female connector combination 114. The straps have been embedded into the tube body 118 and are simply snapped together to connect the tubes. The connection buckles can be any type that permit easy connection and disconnection and are able to withstand the elements. It should be noted that a single strap/connector combination can be used per tube or a pair of strap/connector combinations placed on opposing sides of the tube. Since the strap/connector combinations 112 and 114 are embedded into the tube body 118, the strap/connector combinations 112 and 114 hang loosely when not in use, this embodiment is preferably used when tubes are to be attached to one another. Alternatively, opposing receiving connectors can be placed in the underside of the tube to receive the connector when not in use.

The tubes used in water sports frequently have coolers wedged inside of the inner circle and tied to the sides. This works when the tubes and coolers are appropriately proportioned, however if the inner circumference of the tube is not approximately the cooler length, the cooler will simply fall through unless securely tied. Generally rope, such as bailing twine, is used to tie the coolers and is potentially discarded in the water or surrounding ground rather than in the trash. Further, it takes employee time to cut and clear the ropes off the tubes. The disclosed tubes enable a secure cooler retaining system to be attached to the tubes, enabling the cooler to be placed within a support system. In FIG. 6 the cooler straps 64, 66 and 68 are attached to tube connectors 62 to form a web across the tube. The tube connectors 62 are preferably embedded into the tube 60, as disclosed in FIGS. 3 and 4 with respect to the connectors 38. To securely retain a cooler, six (6) tube connectors 62 are preferably used to enable a single sized tube to be used with smaller coolers. Alternatively, each of the connectors can be wrapped around the tube and secured to itself. By embedding the female portion of the connector, the same tube can be used for coolers or people by adding or removing one or more of the straps, depending upon end use. Additionally, the straps 64, 66 and 68 can provide security for children or small adults, by preventing them from falling through the tube center. Alternatively, the straps can be connected to embedded D-rings, loops or rings 70, as illustrated and disclosed in FIG. 7.

The loops or rings 70 are embedded into the tube 74 through use of an attachment flange 72. The rings 70 are preferable loose on the flange 72 to enable the rings 70 to lie flat against the tube 74. When the loops or rings 70 are used, snap rings or other connecting devices can be used on both the cooler straps 64, 66 and 68, as well as a tube to tube connecting strap, thereby enabling the rings 70 to be used for more than one function. The length of the connecting strap between the tube and the D-ring or, other fastener, is depended upon the attachment method, end use, etc. and will be obvious to those skilled in the art.

In FIG. 8 the outer surface of the tube 80 is molded with tire treads 82 inset into the mold. The treads 82 resemble the treads of a standard tire and provide a more realistic look to the tube 80. The treads 82 are used as an example of the type of designing that is enabled through molding. Other examples would be to design the rafts to look like wood planks, canoes and kayaks to resemble hollowed out logs, etc. Further, color can be changed to reinforce the desired design characteristics or to "coordinate" the device with the sport, i.e. white tubes for snow. The molding also enables information to be "written" on the tube, such as company name, proper use, disclaimers, etc. The identification, instructions, etc. can also be written on the tube rather than molded in.

Figure 9:
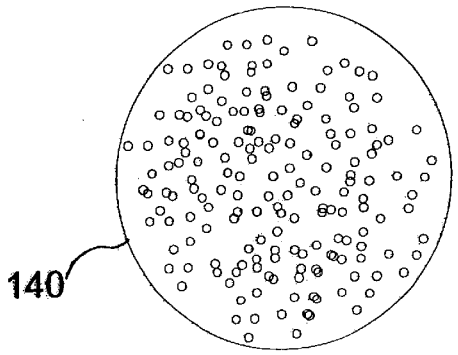
FIG. 9 is a cross sectional view of the disclosed tube using closed cell material.
Figure 10:
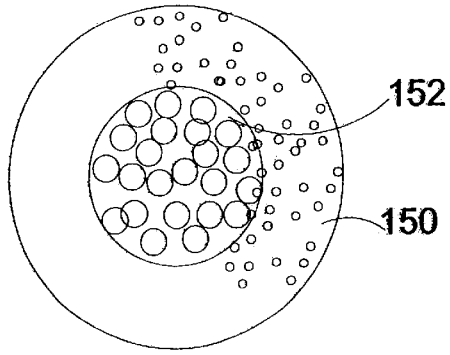
FIG. 10 is a cross sectional view of an alternate embodiment using two material densities.

The cross section of FIG. 9 illustrates a tube manufactured from the closed cell foam. This embodiment uses a single layer body 140 that can be covered with a skin if required. Alternatively, the embodiment illustrated in cross section in FIG. 10 shows dense closed foam outer body 150 over a larger cell closed foam interior 152. This embodiment combines the lightweight properties of the large cell foam with the more durable properties of the smaller cell foam to provide the desired combination of weight and durability. The ratio between the interior 152 and the exterior 150 is dependent upon the properties of each material, i.e. lighter-weight interior material requires a denser exterior material. The ratios will become apparent to those skilled in the art.

Alternatively, Styrofoam beads can replace the large cell foam of FIG. 10. The Styrofoam beads are placed into a urethane covered fabric, or closed cell foam. Additionally machine cut closed cell foam can be covered with a sewn urethane jacket. Neither of these methods is as cost effective as other methods.

Figure 11:
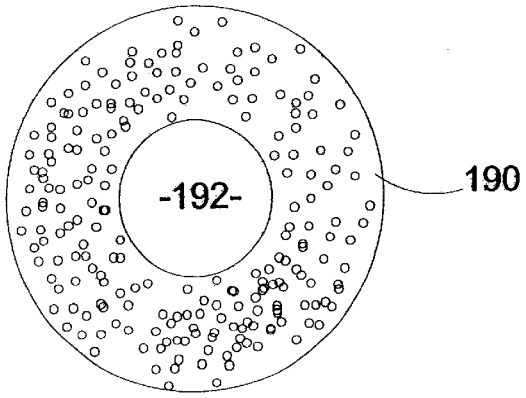
FIG. 11 is an alternate interior construction incorporating a foam outer ring and a hollow interior.

As an alternative to the construction of FIGS. 9 and 10, the tube of FIG. 11 uses a dense closed cell foam outer circle 190 to form an outer ring with an hollow, air filled, interior 192. In this configuration the foam used for the outer circle 190 must have a greater density than necessary for the foregoing embodiments as it must have the ability to retain its shape and rigidity without interior support.

It should be noted that any of the forgoing attachment devices, cup holders, etc. can be interchanged and the illustrated embodiments serve as examples only.

What is claimed is:

1. A recreational device comprising:

an outer surface, said outer surface being moisture impermeable, semi-flexible, tear resistant, and UV resistant; and at least one core, at least a portion of said at least one core being a moisture impermeable, flexible, resilient closed cell foam having a first density;

wherein said core is capable of supporting the weight of an entire body upon a floatable or slidable surface.

2. The recreational device of claim 1 wherein said at least one core is a polyurethane foam.

3. The recreational device of claim 1 further comprising a second inner core, said second inner core being a solid having a second density lighter than said first density.

4. The recreational device of claim 3 wherein said at least one core and said second inner core are concentric.

5. The recreational device of claim 1 further comprising a second inner core, said second inner core being air filled.

6. The recreational device of claim 1 further comprising at least one indentation, said at least one indentation being dimensioned to receive a container.

7. The recreational device of claim 1 further comprising at least one connector receiving area.

8. The recreational device of claim 7 wherein said at least one connector receiving area is embedded within said at least one core.

9. The recreational device of claim 8 further comprising at least one attachment strap, at least one end of said attachment strap interacting with said at least one connector receiving area.

10. The recreational device of claim 9 wherein said device is a recreational ring.

11. The recreational device of claim 10 wherein said at least one attachment strap has a first end interacting with a first of said at least one connector receiving areas and a second end interacting with a second of said at least one connector receiving areas, said second of said at least one connector receiving areas opposing said first of said at least one connector receiving areas, thereby causing said at least one attachment strap to span the diameter of said ring.

12. The recreational device of claim 1 wherein said core is molded with a surface pattern.

13. The recreational device of claim 1 wherein said core is injection molded.

14. The recreational device of claim 1 wherein said core is open molded.

15. The recreational device of claim 1 wherein said outer surface is integral to said core.

16. The recreational device of claim 1 wherein said outer surface is applied to said core subsequent to forming said core.

17. The recreational device of claim 16 wherein said outer surface is from the group consisting of neoprene and latex.

18. The recreational device of claim 1 wherein said device has a density in the range from about 2.0–2.5 pounds per cubic foot.

19. A recreational device having a moisture, tear, and UV resistant outer surface, and at least one molded core, at least a portion of said at least one core being a flexible, resilient closed cell polyurethane foam having a first density, said device having:

a second inner core, said second inner core being a solid having a second density lighter than said first density;

at least one indentation, said at least one indentation being dimensioned to receive a container;

at least one connector receiving area, at least a portion of said at least one connector receiving area being embedded within said at least one core and receiving attachment straps;

wherein said recreation device has a weight of about 2.0–2.5 pounds per cubic foot; and wherein said core is capable of supporting the weight of an entire body upon a floatable or slidable surface.

20. A method of supporting the weight of an entire body on a surface, wherein said surface is water, snow, or ice, using a flexible, lightweight recreational device, said recreational device having a moisture, tear, and UV resistant outer surface and at least one core, at least a portion of said at least one core being a flexible solid material having a first density, comprising the steps of:

a. manufacturing a mold in a predetermined design;

b. filling said mold with a flexible closed cell polyurethane foam;

c. permitting said foam to cure;

d. coating said device with a moisture impermeable coating;

e. placing said recreational device in the water;

f. placing a person's weight on said recreational device;

wherein said recreational device has a density in the range from about 2.0–2.5 pounds per cubic foot and will enable a person on said device to be supported on said surface.

* * * * *